United States Patent [19]

Hawkins

[11] 4,193,067

[45] Mar. 11, 1980

[54] CLOSURE OPERATED BURGLAR ALARM

[75] Inventor: Gary Hawkins, Pontiac, Mich.

[73] Assignee: Harry Belcastro, Sr., Birmingham, Mich. ; a part interest

[21] Appl. No.: 958,194

[22] Filed: Nov. 6, 1978

[51] Int. Cl.[2] ..... G08B 13/08

[52] U.S. Cl. ..... 340/546; 116/86; 292/262; 292/DIG. 15

[58] Field of Search ..... 116/75, 77, 82, 85, 116/86; 340/546, 545, 542, ; 292/262, DIG. 15

[56] References Cited

U.S. PATENT DOCUMENTS

| | | | |
|---|---|---|---|
| 723,478 | 3/1903 | Mills | 340/546 |
| 1,704,967 | 3/1929 | Fuller | 292/DIG. 15 |
| 2,760,460 | 8/1956 | Short | 116/13 |
| 2,812,095 | 11/1957 | Sutherland | 292/339 X |
| 2,870,281 | 1/1959 | Mitchell | 292/339 X |
| 3,797,005 | 3/1974 | Schwarz | 292/262 X |
| 3,921,564 | 11/1975 | Murray | 116/86 X |
| 4,059,299 | 11/1977 | Huntley | 116/77 X |
| 4,122,796 | 10/1978 | Pressler et al. | 116/173 X |

*Primary Examiner*—Daniel M. Yasich

*Attorney, Agent, or Firm*—Basile and Weintraub

[57] ABSTRACT

A burglar alarm is disclosed which detects the unauthorized opening of a door or window. The device has a longitudinally adjustable rod which extends between the burglar alarm and the moveable portion of a closed door or window. An attempt to open the door or window activates the burglar alarm causing the alarm to sound. A built in detent within the burglar alarm holds the alarm in the "on" position until manually released. A releasable locking fabric mounts the alarm to an adjacent stationary door or window frame. The alarm is readily separated by hand from the releasing locking fabric for easy opening of the door or window in the event of an emergency requiring a rapid exit.

10 Claims, 7 Drawing Figures

FIG-5
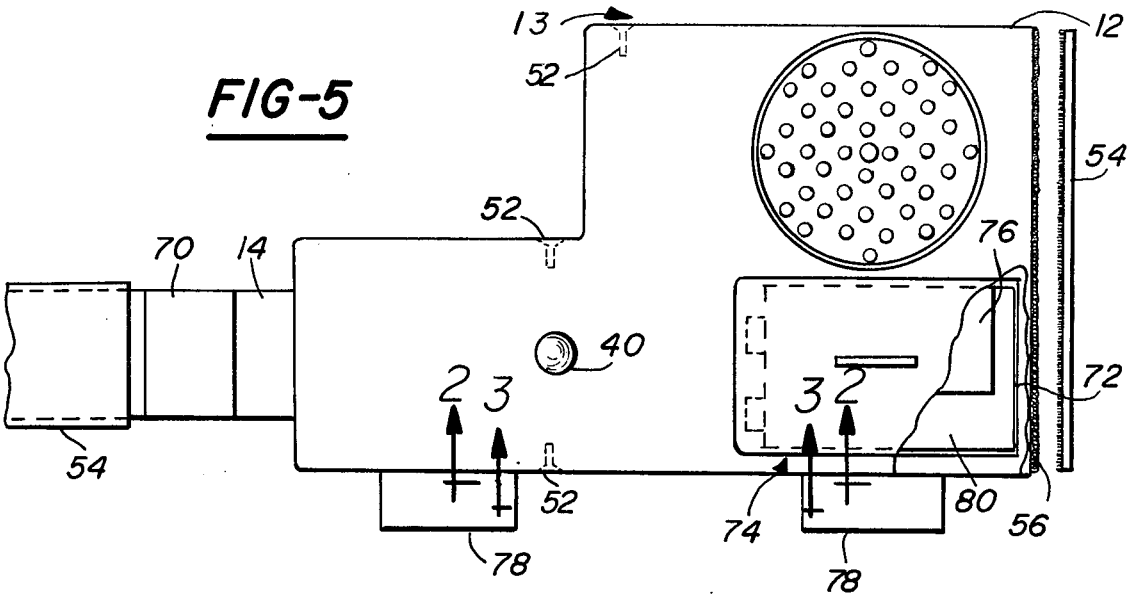
FIG-6
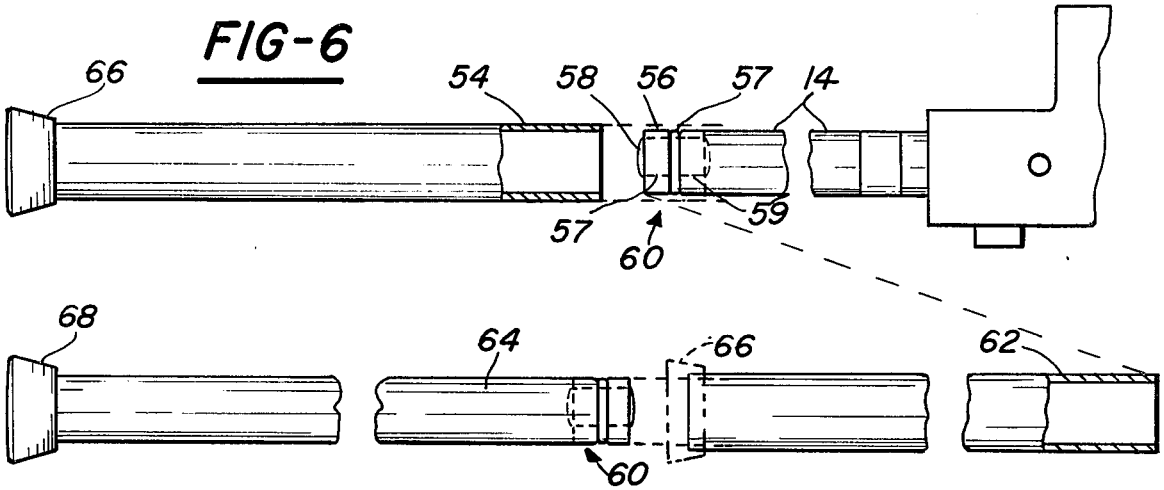
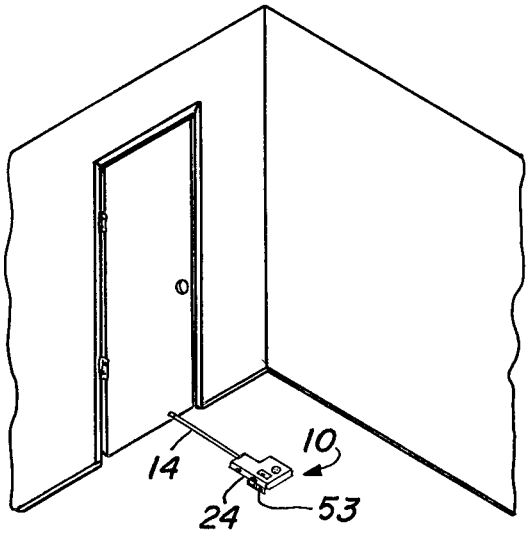
FIG-7

CLOSURE OPERATED BURGLAR ALARM

BACKGROUND OF THE INVENTION

I. Field of the Invention

The present invention relates to the field of burglar alarms for doors and windows, and in particular, to the field of burglar alarms for sliding doors and windows in residences.

II. Prior Art Statement

The following U.S. Patents relate to the field of the present invention. U.S. Pat. No. 2,760,460 relates to a burglar alarm for windows, doors, and other openings. This device comprises a mechanically powered alarm for detecting unauthorized movement of a door knob, a window or a door which results in a mechanically wound spring powered alarm being sounded. The device is fixedly attached to the door or window with a latch for disconnecting the alarm from the adjacent frame member to allow authorized opening of the door or window. No provision is made for adjusting the alarm for the window opening or door opening and no provision is made for readily removing the alarm when it is not needed or for remounting it when it is to be placed in use.

U.S. Pat. No. 3,921,564 discloses a portable burglar alarm having a hand wound spring driven alarm. This device is suitable for burglar protection for doors only. In use the alarm is leaned against the door to be protected and the weight of the device holds the spring driven motor inoperative. When the door is opened, the device falls over and releases the weight of the alarm from the supporting mechanism sounding the alarm.

U.S. Pat. No. 4,059,299 discloses an auxiliary portable lock having an elongated locking bar extending from a housing. The housing has a door engaging element from which the locking bar extends to abut a door casing. An anti-distortion device located within the housing detects any unauthorized movement of the locking bar and sounds an electrical alarm. A key is provided to selectively secure the locking bar to the housing without sounding the alarm, and to allow authorized opening of the door or window without sounding the alarm. All of the elements of this device are not contained within the dwelling to be protected and therefore a knowledgeable burglar can circumvent the protection of this device. Furthermore the device in this instance is not readily removable from the door or window in the event of any emergency.

The above listed U.S. Patent constitute the entire art related to the field of the invention known to the inventor.

SUMMARY OF THE INVENTION

The present invention comprises a burglar alarm for doors and windows comprising a device which abuts the moveable portion of a door or window having an adjustable rod which extends therefrom to abut the stationary frame of the door or window. Any unauthorized opening of the door or window moves the adjustable rod longitudinally into the housing of the burglar alarm making an electrical contact therein and causing the alarm to sound. A detent within the cover of the alarm holds the rod in the inward position once the alarm has been sounded and causes the alarm to continue sounding even after the door or window may have been moved to its closed position. A manual outward movement of the rod from the alarm is required to silence the alarm.

A releasable locking fabric attached to the moveable frame of the door or window and a releasable receiving fabric attached to the cover of the alarm form a means for releasable attaching the alarm to the window or door moveable frame. This releasable attaching means allows the alarm to be easily and quickly removed from the door or window in the event of an emergency. Or, if more convenient, the releasing locking fabric can be attached to the stationary frame of the door or window with equally satisfactory results.

Adjustable telescoping rods of varying length are used to accommodate varying openings between the moveable frame and the adjacent fixed frame of the door or window.

A releasable locking fabric attached to the bottom member of the housing can also be releasably attachable to the carpeting on a floor. In this manner the burglar alarm can be attached to the floor and the adjustable telescoping rod abutted to an inward opening door allowing the burglar alarm to detect any unauthorized opening of the door.

Other objects, advantages, and applications of the present invention will become apparent to those skilled in the art of burglar alarms when the accompanying description of one example of the best mode comtemplated for practicing the invention is read in conjunction with the accompanying drawing.

BRIEF DESCRIPTION OF THE DRAWINGS

The description herein makes reference to the accompanying drawings wherein like reference numbers refer to like parts throughout the several views and wherein;

FIG. 5 illustrates a top plan view of the present invention with the cover installed;

FIG. 6 illustrates a telescoping attachable rod for adjusting the burglar alarm to accommodate the distance between the moveable frame and the fixed frame of a sliding door or window;

FIG. 7 illustrates a perspective view of the present invention employed to detect unauthorized opening of a hinged door opening inward.

DESCRIPTION OF THE PREFERRED EMBODIMENT

Figure 1:
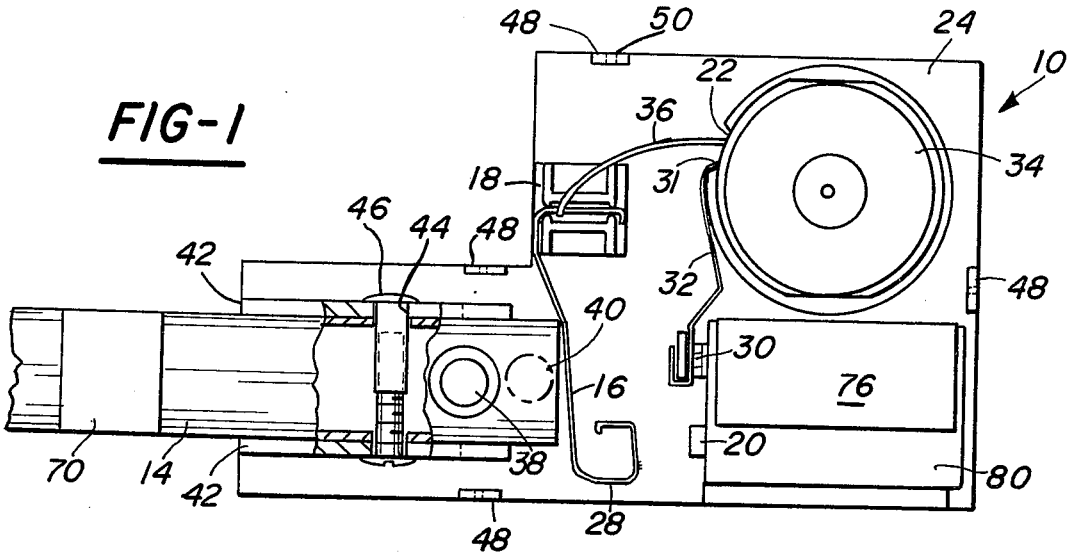
FIG. 1 illustrates a top plan view of the present invention with the cover removed.

Referring now to the drawings and in particular to FIG. 1 wherein there is illustrated at 10 a preferred embodiment of the present invention with the cover 12 removed. The alarm housing 13 comprises a bottom member 24 and a cover 12. A longitudinally translatable rod 14 is moveable from a first position where it is biased outward by a leaf spring 16. The spring 16 is anchored at one end to a pair of vertical upright supports 18 projecting from the bottom member 24. Inward movement of the longitudinally translatable rod 14 to a second position forces the free end 28 of the spring 16 into contact with a second power source terminal 20. A first power source terminal 30 contacts a strip of conducting material 32 which electrically connects the first power source terminal 30 to a first terminal 31 of the alarm 34. A flexible wire conductor 36 connects the fixed end of the leaf spring 16 to a second alarm terminal 22 of the alarm 34. When the free end 28 of the leaf spring 16 contacts the second power source terminal 20 a circuit is completed and the alarm 34 sounds.

Figure 2:
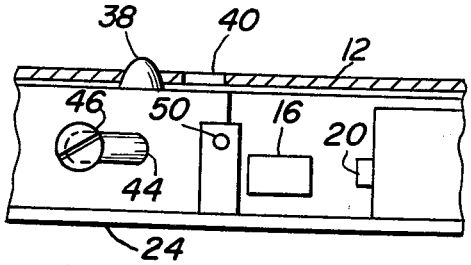
FIG. 2 illustrates a partial front view of the device in FIG. 1 taken along the line 2—2 in FIG. 5.
Figure 3:
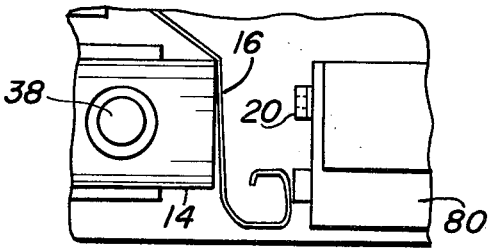
FIG. 3 illustrates a partial top view of the device as in FIG. 1 with the longitudinal rod displaced inward establishing contact between the leaf spring and the second power source terminal to sound the alarm.

When the rod 14 reaches the second position, an upwardly biased detent 38 engages an aperture 40 in a cover 42 (FIGS. 2 and 4) to hold the leaf spring 16 in contact with the second power source terminal. The alarm continues to sound until the longitudinally translatable rod 14 is manually moved to the first position and the detent 38 is disengaged from the aperture 40 in the cover 12. When the rod 14 is moved to the first position the free end 28 of the leaf spring 16 leaves contact with the second power source terminal 20 to cause the alarm to cease sounding. The leaf spring 16 is biased toward the longitudinally translatable rod 14 holding the rod 14 in its first position by spring force.

The longitudinally translatable rod 14 is positioned within the housing 13 by a pair of spaced apart vertical walls 42 which are integral with the bottom member 24. A pair of aligned horizontal slots 44 along the vertical walls 42 are configured to receive a pin 46 which passes through the longitudinally translatable rod 14 near its end. The pin 46 is slidingly moveable within the horizontal slots 44 and the movement of the pin 46 along the slots 44 defines the movement of the longitudinally translatable rod 14 from its first position to its second position.

The cover 12 has a form complimentary to the bottom member 24 and has downward projecting sides to hold the cover 12 spaced above the bottom member 24. A plurality of vertical tabs 48 are positioned around the periphery of the bottom member 24 and are integral therewith. Each vertical tab 48 has a threaded aperture 50 passing therethrough which aligns with a plurality of apertures disposed along the perimeter of sides of the cover 12. A plurality of threaded fasteners 52 pass through the aligned apertures in the cover 12 and engage the threaded apertures 50 in the vertical tabs 48 to attach the cover 12 to the bottom member 24.

The cover 12 has a pair of flanges 78 projecting from one side wall which are configured to fit into the track of a sliding door or window and align the housing 13 with the track. An opening 74 in the cover 12 provides access to a battery 80 which serves as a power source in the preferred embodiment. A piece of sponge 72 affixed to the side of the cover 12 retains the battery 80 in position and biases the battery 80 toward the strip of conducting material 32. A strip of fabric 76 is affixed at one end to the bottom member 24 the other end is wrapped partly around the battery 80 to serve as a means for removing the battery when the other end is pulled. A cover—75—snugly fits the battery opening 74 to cover the battery 80 during normal use.

To secure the housing 13 to the moveable frame of a sliding door or window a releasable locking fabric 53 (FIG. 5) is attached to the door or window near the bottom by any suitable fastening means such as a adhesive, screws, tacks, or the like. A releasable receiving fabric 56 is secured to the end of the cover 12. When the releasable receiving fabric 56 engages the releasable locking fabric 54 the housing 13 is releasably secured to the moveable frame of the door or window. The releasable locking fabric 54 and the releasable receiving fabric 56 hold the housing 13 of the burglar alarm securely to the moveable frame of the door or window under conditions of normal operation. However, the bond between the locking fabric 54 and the receiving fabric 56 can easily be broken by hand in the event of an emergency when a door or window must be opened quickly.

The end of the rod 14 has affixed thereto a releasable locking mechanism 60 (FIG. 6) for adjusting a tube 54 telescoped over the rod 14 in a releasable locking manner and extend the effective length of the rod 14 to the adjacent stationary frame of the sliding door or window to be protected. A disc 56 has an outside diameter similar to that of the rod 14 and an offset aperture 57 passing through the disc which is off-set from the center of the disc. A similar offset aperture 59 is disposed in the end of the rod 14. A headed pin 58 slidingly passes through the aperture 57 and is pressed in the aperture 59 in the end of the rod to secure the disc 56 to the end of the rod in a rotatable manner. The tube 54 is telescopingly received by the rod 14. When the end of the tube 54 abuts the stationary frame of the sliding door or window to be protected, the tube 54 is rotated relative to the rod 14 and the offset of the aperture 57 within the disc 56 wedges the disc 56 to the inside wall of the tube 54 locking the tube 54 in place on the rod 14. A longer tube 62 can be used in place of the tube 54 to provide a greater extension of the rod 14 to the adjacent stationary window or door frame. A cap 66 on the end of the tube 54 or the longer tube 62 prevents the end of the tube from scratching the adjacent stationary frame of the door or window. In the event that even a longer extension is required from the end of the rod 14 than can be provided by the longer tube 62, the end cap 66 can be removed from the longer tube 62 and an intermediate rod 64 affixed to the end of the longer tube 62. A second releasable locking device 60 is affixed to the inward end of the intermediate rod 64 allowing it to be releasably locked to the tube 62. A cap 68 on the outer end of the tube 64 protects the stationary frame of the door or window from scratches.

The interposing of the burglar alarm 10 and the extendable tubes 54, 62, and/or the intermediate rod 64 between the movable frame of a window and a stationary frame, not only sounds an alarm when an attempt is made to open the window, but physically prevents opening of the window or door beyond the point where the rod 14 is moved to the second position.

The adjustable length of the burglar alarm 10 also allows a door or window to be opened a distance to allow ventilation but prevents further opening of the door or window to allow entry of a burglar, sounding an alarm when an attempt is made to enlarge the opening beyond the authorized amount.

As an alternate means for assembling the cover to the bottom member comprises a pair of vertical posts disposed on either side of the walls 42 integral with the bottom member 24, having a threaded aperture at their center and extending upward a distance short of the cover 12. A third vertical post is disposed proximate the center of the bottom member spaced apart from the conductors 32, integral with the bottom member 24 and having at its center a threaded aperture. A plurality of apertures in the cover 12 aligned with the threaded apertures in the vertical posts receive a plurality of threaded fasteners to fasten the cover 12 to the bottom member 24.

A band of color 70 around the rod 14 near where in enters the housing 13 indicates the point to which the tubes 54 and 62 can be telescoped over the rod 14. If the tubes are telescoped beyond the colored band 70, the end of the tube could interfere with the movement of the rod 14 from the first position to the second position.

Figure 4:
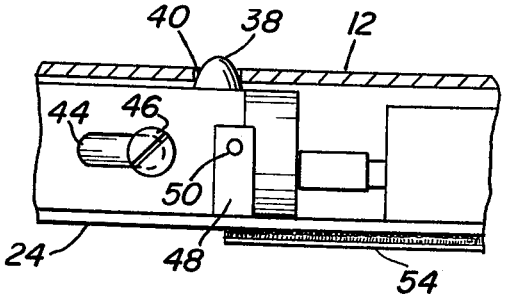
FIG. 4 is similar to FIG. 2 except that the longitudinal rod has been displaced inward and the detent engaged to hold the contact established between the leaf spring and the second power source terminal.

Referring now to FIG. 7 wherein there is illustrated another embodiment of the present invention where the burglar alarm is used to protect an inward swinging hinged door. A piece of releasable locking fabric 53 is attached to the outside surface of the bottom member 24 (FIG. 4). The releasable locking fabric 53 engages the nap of a carpet attached to the floor of the room. When the door is closed the burglar alarm is attached to the carpet so that the end of the rod 14 abuts the inside surface of the door near the opening end. When an attempt is made to open the door the alarm sounds in the manner described hereinabove.

Having thus described my invention what I claim is:

1. A burglar alarm for closures, such as doors and windows, having a bottom member and a cover comprising:

an alarm responsive to an electrical signal;

a switch means including a leaf spring means for interconnecting the alarm to a power source;

a longitudinally translatable rod movable from a first position, whereby the switch means is open, said rod adjacent an edge of said closure when the closure is near a closed position, and to a second position wherein the switch means is maintained closed, sounding the alarm;

said leaf spring means having one end spacedly fixed relative to the rod and biasing an end of the rod in the first position;

means for releasably holding the rod latched in the second position when the second position has been reached;

means for guiding the rod from the first position to the second position; and means for adjusting the length of the rod to extend from a fixed surface to a movable surface of a door or window whereby an attempt to open the door or window moves the rod to said second position to sound the alarm.

2. A burglar alarm as defined in claim 1 with the cover further comprising a releasable locking fabric attachable to a moveable window frame and a mating releasable receiving fabric attached to the burglar alarm to releasably attach the burglar alarm to the window frame.

3. A burglar alarm as defined in claim 2 further comprising the cover having a projection to fit a groove in a slide of a door or window.

4. A burglar alarm as defined in claim 3 further comprising a releasable locking fabric attached to the outside surface of the bottom member to engage a carpet covered floor and anchor the rod in abutment with a closed door.

5. A burglar alarm as defined in claim 4 wherein the switch means comprises a leaf spring of conducting material cantilevered at one end to the bottom member, the free end adapted to contact a second power source terminal, the leaf spring biased in an open position, a strip of conducting metal attached to a first power source terminal at one end the other end attached to a first terminal of the alarm, a conductor leading from the one end of the leaf spring to a second terminal of the alarm wherein forcing the leaf spring against the second power source terminal causes the alarm to sound.

6. A burglar alarm as defined in claim 5 wherein the leaf spring means biasing the end of the rod in the first position comprises a leaf spring biased to hold the rod in the first position.

7. A burglar alarm as defined in claim 6 wherein the means for releasably holding the rod in the second position comprises a detent button attached to the rod near an inside end, the button biased radially outward and aligned to engage an aperture in the cover when the rod has been displaced inward to the second position to sound the alarm, and whereby the detent button engaging the aperture holds the rod in the second position.

8. A burglar alarm as defined in claim 7 wherein the means for guiding the rod from the first position to the second position comprises a pair of parallel spaced apart vertical walls integral with the bottom member spaced to slidingly receive the rod, a pair of horizontal elongated aligned slots in the spaced apart walls, a pin passing through the slots and slidingly moveable therein, the pin passing through the rod near its inner end and fixedly attached thereto, and whereby movement of the pin within the slot determines the movement of the rod from the first position to the second position.

9. A burglar alarm as defined in claim 8 wherein the means for adjusting the length of the rod comprises a rod with a tube telescoped thereover, a disc equal in diameter to the rod aligned with the rod at its outer end, a first aperture through the disc having a center offset from the center of the disc, the rod has a second offset aperture in the outer end, a headed pin slidingly passes through the first aperture and is pressed into the second aperture and retained therein by friction, and whereby rotation of the tube relative to the rod wedges the disc against an inner wall of the tube to lock the rod and the tube together.

10. A burglar alarm as defined in claim 9 wherein the rod in cooperation with the alarm prevents the opening of a door or window beyond an authorized amount.

* * * * *